US005429399A

United States Patent [19]

Geringer et al.

[11] Patent Number: 5,429,399

[45] Date of Patent: Jul. 4, 1995

[54] ELECTRONIC DELAYED EGRESS LOCKING SYSTEM

[76] Inventors: Arthur Geringer, 5029 E. Jacobs Ct., Agoura, Calif. 91301; Richard Geringer, 12628 Ambermeadow, Moorpark, Calif. 93021; David Geringer, 28364 Balkin, Agoura, Calif. 91301

[21] Appl. No.: 964,131

[22] Filed: Oct. 22, 1992

[51] Int. Cl.[6] ..... E05B 65/10

[52] U.S. Cl. ..... 292/92; 292/251.5; 292/DIG. 65

[58] Field of Search ..... 292/DIG. 65, 21, 92, 292/251.5

[56] References Cited

U.S. PATENT DOCUMENTS

| | | | |
|---|---|---|---|
| 4,328,985 | 5/1982 | Logan | 292/DIG. 65 X |
| 4,439,808 | 3/1984 | Gillham | 292/144 X |
| 4,609,910 | 9/1986 | Geringer et al. | 292/DIG. 19 X |
| 4,652,028 | 3/1987 | Logan et al. | 292/251.5 |
| 4,652,862 | 3/1987 | Verslycken | 292/92 X |
| 4,762,350 | 8/1988 | Hurtado | 292/259 R |
| 4,763,937 | 8/1988 | Sittnick, Jr. et al. | 292/92 X |
| 4,803,482 | 2/1989 | Verslycken | 292/92 X |
| 4,986,099 | 6/1991 | Johnson et al. | 292/144 X |
| 5,000,497 | 3/1991 | Geringer et al. | 292/251.5 |

*Primary Examiner*—Rodney M. Lindsey
*Attorney, Agent, or Firm*—John J. Posta, Jr.

[57] ABSTRACT

A security system for use on doors which have an electrically operated door locking mechanism is disclosed, which security system is operative to provide a preset egress time delay following an effort to exit through the controlled door before actuating the door locking mechanism to unlock the door and allow egress. During the egress time delay, the system provides a visual input of the time remaining until the door locking mechanism will unlock the door to allow egress or access therethrough. In the preferred embodiment, a speech synthesizer and digital display is also utilized to inform the individual demanding egress or access of the delay, and to provide other information as desired.

23 Claims, 4 Drawing Sheets

ELECTRONIC DELAYED EGRESS LOCKING SYSTEM

BACKGROUND OF THE INVENTION

Field of the Invention

The present invention relates generally to security systems for doors, and more particularly to an improved security system for use with an electrically operated door locking mechanism, which security system is operative to provide a preset delay following an effort to exit through the controlled door before actuating the door locking mechanism to unlock the door and allow egress.

Security doors have evolved over the years from simple doors with heavy duty locks to sophisticated egress and access control devices. In bygone times, heavy duty chains and locks were the norm on security doors which were not generally used, or which were used to prevent theft or vandalism. However, fire codes have made such relatively simple door locking systems obsolete, at least in most developed countries. Emergency exit doors are required by law to be provided in all commercial buildings, and such doors must be operative in the event of a fire, earthquake, or other emergency.

These exit doors are typically provided with heavy horizontal push bars, which unlock the door upon actuation and which may provide an alarm of some sort. The early alarms on such doors were either mechanical in nature, such as wind-up alarms contained on the push bar mechanism, or completely separate electrical circuits actuated by a switch opened as the door was opened. Accordingly, egress from such doors was immediate, and, although egress was accompanied by an alarm, typically the person leaving through the door was long gone by the time security personnel arrived.

Many stores suffer great losses through emergency doors, with thieves escaping cleanly through the emergency doors with valuable merchandise. In addition, industrial companies also suffer pilferage of valuable equipment and merchandise through such emergency exit doors. While one solution is to have a greater number of security personnel patrolling the emergency exit doors, to do so is also an expensive solution.

As might be expected, the art reflects a number of devices which attempt to solve this problem. A series of such devices is found in U.S. Pat. No. 4,257,631, in U.S. Pat. No. 4,328,985, in U.S. Pat. No. 4,354,699, in U.S. Pat. No. 4,652,028, and in U.S. Pat. No. 4,720,128, all to Logan, Jr. or Logan, Jr. et al. The Logan, Jr. patents begin with the Logan, Jr. '631 patent, which describes a system activated by a push bar which, upon depression, moves a switch carried by the door to sound an alarm and start a timer delay. After the delay, the door is unlocked.

The Logan '985 patent teaches a hydraulic system for accomplishing the delay prior to unlocking the door, and the Logan '699 patent describes a retrofit locking device of the same type, but usable with any door latching system. The Logan et al. '028 patent and the Logan, Jr. et al. '128 patent both teach an electromagnet mounted on a door jamb, an armature on the door held by the electromagnet to retain the door in the closed position, and a switch used to indicate when the door is being opened or tampered with. The Logan, Jr. et al. '128 patent adds a set of contacts to confirm that the armature properly contacts the electromagnet.

U.S. Pat. No. 4,439,808, to Gillham, describes another system which also uses an armature on a door and an electromagnet on the door jamb. The armature has shoulders to retain the door in the closed position even if someone exerts enough pressure on the door to otherwise slide the armature off of the electromagnet. U.S. Pat. No. 4,439,808, to Gillham, is hereby incorporated herein by reference.

Two other patents are relevant, particularly since they are both assigned to the assignee of the present invention. Specifically, these patents are U.S. Pat. No. 4,609,910 and U.S. Pat. No. 5,000,497, both to Geringer et al. The Geringer et al. '910 patent teaches a system with an armature on a door, an electromagnet on a door jamb, and a switch used to tell when an attempt is made to open the door. The Geringer et al. '497 patent teaches a novel door-mounted armature and door jamb-mounted electromagnet. U.S. Pat. No. 4,609,910 and U.S. Pat. No. 5,000,497 are both hereby incorporated herein by reference.

While these references represent a substantial improvement in the state of the art to date, there are still several disadvantages and problems inherent in the art. For example, in an emergency, someone trying to get out will find that the door does not immediately open, and may panic and leave the door prior to it opening after a delay. In addition, the present devices may not fully comply with safety regulations, and thus may no longer be commercially competitive.

It is accordingly the primary objective of the present invention that it provide a security system which, when actuated by someone trying to open the door, will provide information about the delay imposed before the door will be opened. Such information must serve to inform the individual that the door will be opened following a short delay. It is also desirable that the exact period of the delay be made known to the individual.

It is also an objective of the present invention that the security system taught therein operate to unlock the door after a preset period of time, with that preset period being adjustable in duration. In addition, it is an objective that the system operate to ensure that the lock will operate in a fail-safe mode in the event of a fire or another bona fide emergency, operating all doors in the affected area. Also, it is an objective that the system allow immediate egress or access to a security officer. It is an additional objective that the system provide information on its operation to a single remote location.

The security system apparatus of the present invention must also be of a construction which is both durable and long lasting, and it should also require little or no maintenance to be provided by the user. In order to enhance the market appeal of the security system of the present invention, it should also be of inexpensive construction to thereby afford it the broadest possible market. Finally, it is also an objective that all of the aforesaid advantages and objectives of the present invention be achieved without incurring any substantial relative disadvantage.

SUMMARY OF THE INVENTION

The disadvantages and limitations of the background art discussed above are overcome by the present invention. With this invention, any type of electrically operated door locking system may be controlled to delay egress or access through the door. The system of the present invention will set off an alarm, and begin a countdown to the time when the door will be unlocked. The time remaining till the door is opened is prominently displayed on the control unit, which is mounted on the door in a housing which resembles a push bar and which functions as a trigger switch used to actuate the system.

The door-mounted control unit is supplied with power from a remote location. Inputs from one or a series of fire or smoke alarms are also supplied to the door-mounted control unit; whenever the fire or smoke alarms indicate that there in an emergency situation, the door-mounted control unit will immediately enable the electrically operated lock to open, thereby allowing egress or access through the door. Like most of the locks described above in the cited art, the security system of the present invention causes the electrically operated lock to lock whenever a voltage is supplied from the door-mounted system to the locking mechanism. Thus, in an emergency, if the power is cut, the locking mechanism will automatically open.

The security system is microprocessor actuated, with the microprocessor being located within the housing of the door-mounted control unit. In the preferred embodiment, when the door-mounted housing is pushed, a switch which comprises the system trigger is actuated. Thus, when an individual attempts to open the door by pushing on the push bar (the housing), the system trigger will operate to initiate the operation of the security system to allow egress or access through the door.

The microprocessor in the door-mounted control unit begins a countdown when the system trigger is operated to demand egress or access. Unlike the systems of the prior art, the security system of the present invention includes a mechanism to inform the individual who operated the trigger switch to demand egress or access just how long it will be until the door is unlocked. This time period is programmable in the individual door-mounted control unit to allow different doors to have different delay times until egress or access is allowed.

In the preferred embodiment, the mechanism to inform the individual demanding egress or access how long until the door will be unlocked includes a visual display which counts down the time until the door will be opened. A two segment numeric display is mounted on the housing of the door-mounted control unit. This two digit display is sufficiently large to allow it to be easily viewed. For example, a one-inch high, two digit, seven segment LED display may be utilized.

The preferred embodiment also includes a secondary mechanism to inform the individual demanding egress or access how long until the door will be unlocked in addition to the visual display. An audible warning system is included in the door-mounted control unit to provide this additional information to the individual. This audible warning system is in the preferred embodiment an electronic speech synthesizer, which will provide instructions as to the delay until the door is unlocked. In the preferred embodiment, several languages may be programmed into the device, with a choice of one or more languages being selectable.

Other features included in the door-mounted control unit include a key-operated switch to allow immediate egress or access through the door to authorized individuals. Use of the key to gain immediate egress or access will rearm the system after a short delay, which may be programmed as desired. The key-operated switch may also be used to deactivate the system. The LED display may be used to indicate whether the system is armed or disarmed.

A door switch input may also be provided to the door-mounted control system. This input will prevent the lock from being armed until the door is closed. The entire system may also be controlled from a master console at a remote location. Thus, the door-mounted system may be armed, disarmed, or locked out from the remote location by the master console. The status of the door-mounted control unit is in the preferred embodiment indicated by a series of LED's located on the master console at the remote location. The system may also be set up so that events occurring at one door may control a series of other doors.

It may therefore be seen that the present invention teaches a security system which, when actuated by an individual trying to open a secured door, will provide visual and/or audible information about the delay before the door will be unlocked to the individual trying to open the door. Such information will serve to precisely and definitely inform the individual that the door will be opened following a brief delay. In fact, the exact delay will be presented by the preferred embodiment device in both visual form and in audible form to the individual seeking egress or access through the door.

The security system of the present invention enables the locking mechanism to operate to open the door after a preset period of time, with that preset period being adjustable in duration. In addition, the security system of the present invention operates to ensure that the locking mechanism will operate in a fail-safe mode, immediately unlocking the door in the event of a fire or another bona fide emergency, and operating all doors in the affected area. Also, the security system of the present invention allows immediate egress or access to a security officer. It also provides information on its operational status to a single remote location.

The security system apparatus of the present invention is of a construction which is both durable and long lasting, and which will require little or no maintenance to be provided by the user. In order to enhance the market appeal of the security system of the present invention, it is of relatively inexpensive construction to thereby afford it the broadest possible market. Finally, all of the aforesaid advantages and objectives of the present invention are achieved without incurring any substantial relative disadvantage.

DESCRIPTION OF THE DRAWINGS

These and other advantages of the present invention are best understood with reference to the drawings, in which.

DETAILED DESCRIPTION OF THE PREFERRED EMBODIMENT

Figure 1:
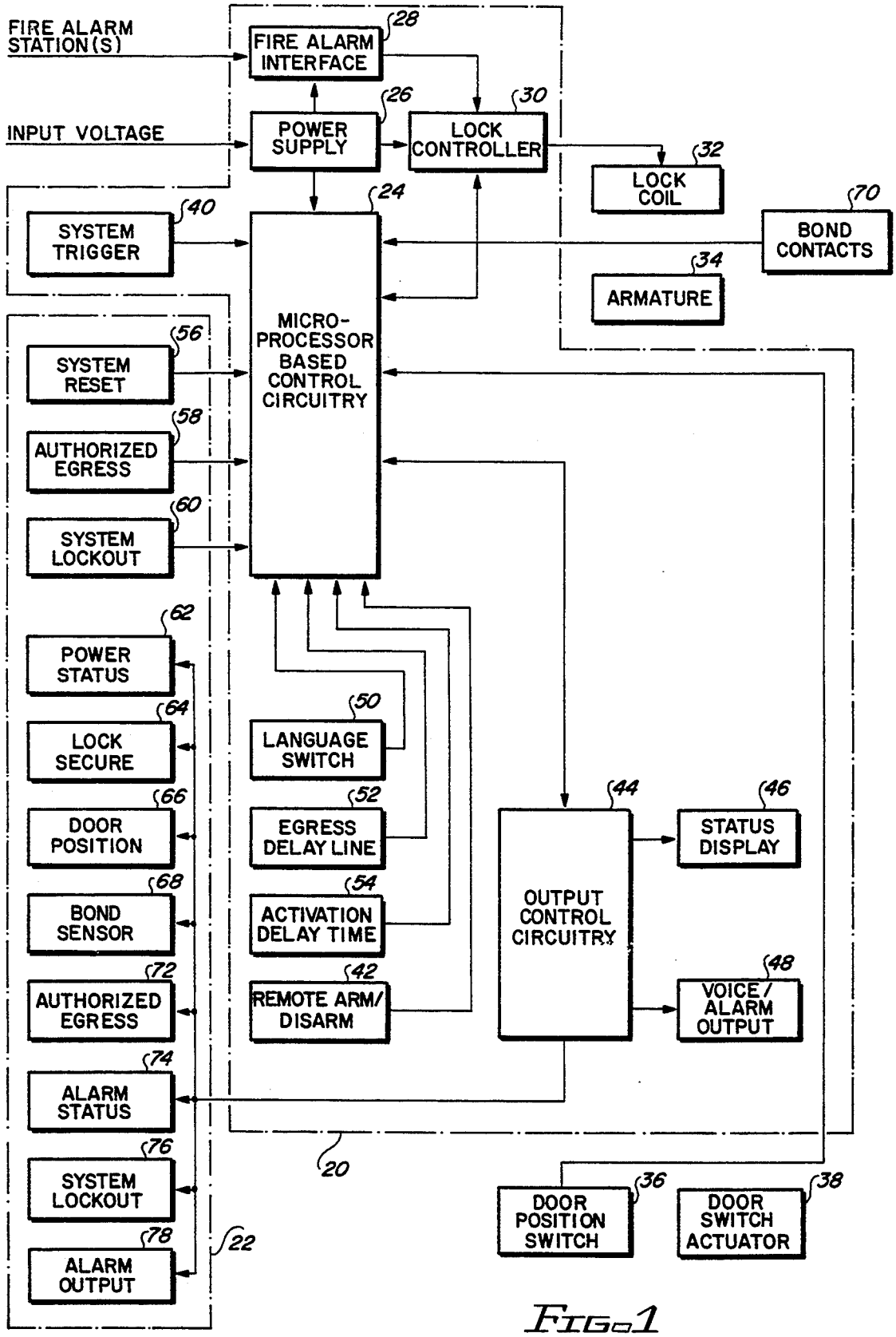
FIG. 1 is a functional schematic block diagram of the preferred embodiment delayed egress locking system of the present invention, showing the various controls used to operate the system.

The preferred embodiment of the present invention is illustrated in FIG. 1, which shows a number of components which are included in a door-mounted control unit 20, a number of additional components which are included in a remote master console 22, and a number of additional components mounted on a door (not shown), as well as other inputs supplied to the door-mounted control unit 20 from a remote location. It is important to understand that while the system illustrated schematically in FIG. 1 is but an example of the preferred implementation of the present invention using a specific lock hardware implementation, the door-mounted control unit 20 and the remote master console 22 may be used with any of a wide variety of different electrically operated lock hardware implementations.

Note that the heart of the door-mounted control unit 20 is microprocessor-based control circuitry 24, which is used as the controller for the system. The microprocessor-based control circuitry 24 is supplied with power by a power supply 26, which receives an input voltage from a voltage source (not shown). The input voltage supplied to the power supply 26 may be either 12 Volts D.C. or 24 Volts D.C.; the power supply 26 is a regulated and filtered power supply, which protects the circuitry of the door-mounted control unit 20 from damage due to power fluctuations.

The power supply 26 also provides power to a fire alarm interface 28, which normally receives a high input (a digital "1") from one or more fire alarm stations (not shown). Since the system of the present invention is a fail-safe system, the presence of a high signal from the fire alarm station(s) is used to indicate that there are no emergency conditions. The absence of a high signal (a digital "0") from the fire alarm station(s), whether caused by an actual fire condition or by a fault in the system, will be interpreted by the system as an emergency condition. Note that the fire alarm interface 28 could also use signal(s) from one or more smoke detectors instead of fire alarm station(s), or a combination of both.

The power supply 26 also provides power to a lock controller 30. The lock controller 30 receives an input from the microprocessor-based control circuitry 24, and a second input from the fire alarm interface 28. Both of these inputs are normally high (each would be a digital "1"), so the absence of either high input (a digital "0") represents a situation in which it is necessary to unlock the door (not shown). The absence of a high signal (a digital "0") from the fire alarm interface 28 indicates that an emergency condition is occurring, as indicated by the inputs to the fire alarm interface 28 from the fire alarm station(s). The absence of a high signal (a digital "0") from the microprocessor-based control circuitry 24 indicates that the microprocessor-based control circuitry 24 has executed an instruction to unlock the door.

The lock controller 30 may be of conventional design, and will vary depending on what type of electrically operated locking mechanism is used. In FIG. 1, the locking mechanism is of the type using an electromagnetic door locking mechanism. The lock controller 30 drives a lock coil 32, typically mounted on a door jamb (not shown), with the lock coil 32 attracting and holding an armature 34 mounted on the door (also not shown). The lock controller 30 may use hardware as simple as a relay to cleanly disconnect the lock coil 32 from the power supply 26, but in the preferred embodiment the lock controller 30 also includes additional degaussing circuitry to ensure a quick release of the armature 34 from the lock coil 32. Such circuitry is known to those skilled in the art, and is shown, for example, in the Gillham patent incorporated by reference above.

A door position switch 36 is used to indicate whether or not the door (not shown) is closed. The door position switch 36 is necessary, since it is undesirable to energize the lock coil 32 until the door is closed and the armature 34 is in position to properly contact the lock coil 32. The door position switch 36 may be a stand-alone device such as a mechanical switch, mounted either on the door (not shown) or on the door jamb (also not shown). Alternately, the door position switch 36 may be a magnetic switch, mounted for example on the door jamb, in which case a door switch actuator 38 is required to be mounted on the door. The door switch actuator 38 would be a small magnet if it was used with a door position switch 36 which was a magnetic switch.

The door-mounted control unit 20 includes a system trigger 40, which is typically a switch built into the door-mounted control unit 20. When an individual presses on the door-mounted control unit 20, the system trigger 40 will signal the microprocessor-based control circuitry 24 that egress or access has been demanded. Thus, the system trigger 40 is used to indicate that someone has tried to open the door (not shown).

When the system trigger 40 is operated, the microprocessor-based control circuitry 24 will sound an alarm (as will be explained in detail below), and will begin timing a preset delay time. Upon the conclusion of the preset delay time, the microprocessor-based control circuitry 24 will cause the lock controller 30 to deenergize the lock coil 32, unlocking the door (not shown) and allowing egress or access.

In the preferred embodiment, the door-mounted control unit 20 also includes a remote arm/disarm switch 42 connected to the microprocessor-based control circuitry 24. The remote arm/disarm switch 42, which is typically a key-operated single-pole, double throw switch, is mounted on the door-mounted control unit 20 in a position accessible from the outside thereof. By turning the remote arm/disarm switch 42 in one direction, the system is armed (or, if it was already armed, is reset).

Following arming or resetting, the microprocessor-based control circuitry 24 will cause the lock controller 30 to deenergize the lock coil 32 for a preset interval referred to as the activation delay time to allow authorized personnel egress or access through the door (not shown). By turning the remote arm/disarm switch 42 in the opposite direction, the system is disarmed.

Three elements operated by the microprocessor-based control circuitry 24 and also included in the door-mounted control unit 20 are quite novel. Output control circuitry 44 is driven by the microprocessor-based control circuitry 24 whenever the system trigger 40 is actuated to demand egress or access. In the most advanced devices prior to the present invention, the components used instead of the lock controller 30 would merely sound an alarm. The novel function of the output control circuitry 44 is that it provides information to an individual who has demanded egress or access, including how long it will be until the door is unlocked.

Figure 6:
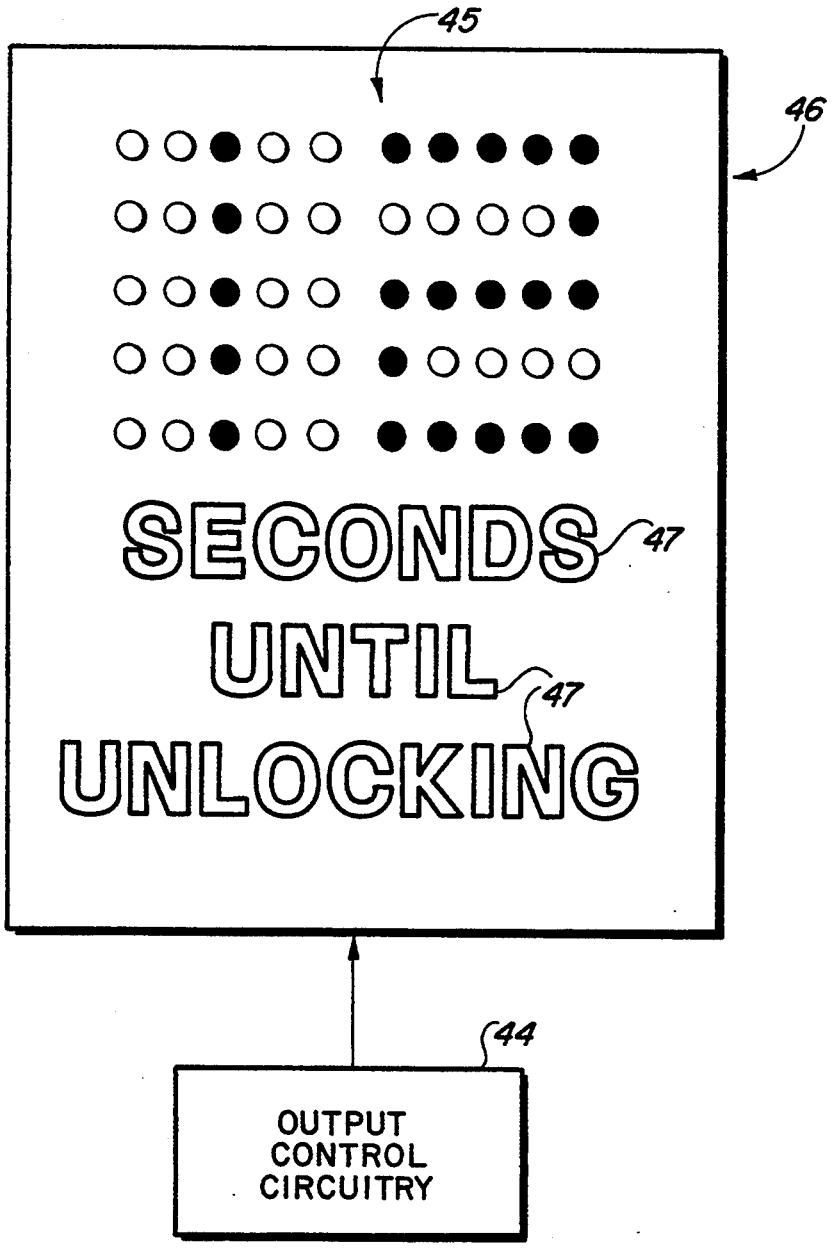
FIG. 6 is s typical status display of the delayed egress locking system.

Thus, the output control circuitry 44 is used to drive a status display 46 whenever the system trigger 40 has been actuated to demand egress or access. The status display 46 of the preferred embodiment is a two digit, seven segment LED display mounted in the door-mounted control unit 20 where it is visible from the exterior thereof. FIG. 6 illustrates a typical status display which might include a LED display 45 which, in association with the lettering 47, provides information as to the time remaining until the door is unlocked. Upon actuation of the system trigger 40, the microprocessor-based control circuitry 24 will drive the output control circuitry 44 to cause the status display 46 to count down the interval prior to the door (not shown) being opened. Thus, the number of seconds remaining until the door is opened will be visible on the status display 46. When demand for egress or access has not been made, the status display 46 is used in the preferred embodiment to indicate whether or not the system is armed, which may be done by lighting all or some of the segments.

In addition, the output control circuitry 44 is used to drive a voice/alarm output 48 whenever the system trigger 40 has been actuated to demand egress or access. Upon actuation of the system trigger 40, the microprocessor-based control circuitry 24 will drive the output control circuitry 44 to cause the voice/alarm output 48 to produce either a synthesized speech output, an alarm, or, in the preferred embodiment, both outputs in an alternating fashion. In the preferred embodiment, the voice/alarm output 48 will produce a synthesized speech output informing the individual who has demanded egress or access that the door will open in a certain amount of time, as well as certain other information.

For example, the voice/alarm output 48 may announce, "This door will be unlocked in 60 seconds. Security has been informed that you are attempting to exit through this door." Following the warning announcement, the same the voice/alarm output 48 will then produce an alarm signal. The warning announcement may be alternated with the alarm signal until the egress delay time has ended, and the door (not shown) is opened.

Several other optional switches may be used to vary the operation of the system, all of which are DIP switches in the preferred embodiment. A language switch 50 may be used to choose which language the announcement will be made in. Alternately, the language switch 50 may be used to select two languages, with the warning announcement being given in first one language and then the other. An egress delay time switch 52 may be used to select the delay between actuation of the system trigger 40 and the microprocessor-based control circuitry 24 ultimately causing the lock controller 30 to unlock the door (not shown). Finally, an activation delay time switch 54 may be used to select the activation delay time following system rearming or resetting. Upon rearming or resetting, the microprocessor-based control circuitry 24 will cause the lock controller 30 to deenergize the lock coil 32 for the activation delay time to allow authorized personnel egress or access through the door.

The remote master console 22 includes both control switches used to operate the door-mounted control unit 20, and status indicator LED's. A system reset switch 56 is used to reset the door-mounted control unit 20 from the remote master console 22 following an alarm. An authorized egress switch 58 is used to allow authorized personnel egress or access through the door (not shown) for a period of time equal to the activation delay time. Finally, a system lockout switch 60 is used to cause the microprocessor-based control circuitry 24 to keep the door locked. This switch disables the system trigger 40 from allowing the door to be opened, even after the egress delay time. Following activation of the system lockout switch 60, only a fire alarm station signal can cause to door to be opened.

Eight status indicator LED's are also included on the remote master console 22. A power status LED 62 is used to confirm that the microprocessor-based control circuitry 24 is powered; if so, the power status LED 62 is lit. A lock secure LED 64 is used to indicate whether or not the lock controller 30 is energizing the lock coil 32; the lock secure LED 64 is lit when the lock coil 32 is energized. A door position LED 66 is used to indicated whether the door (not shown) is closed or not; if the door position switch 36 is activated, indicating that the door is closed, the door position LED 66 is lit.

A bond sensor LED 68 is used to confirm that the electromagnetic door locking mechanism components are engaging properly. If the armature 34 is engaging the portion of the electromagnetic door locking mechanism containing the lock coil 32, a pair of electromagnetic door locking mechanism bond contacts 70 located on the armature 34 and the portion of the electromagnetic door locking mechanism containing the lock coil 32 will make contact, and the bond sensor LED 68 will be lit. Such contacts are illustrated in U.S. Pat. No. 4,720,128, to Logan, Jr. et al., which patent is hereby incorporated herein by reference.

An authorized egress LED 72 is lit whenever the authorized egress switch 58 or the remote arm/disarm switch 42 has been used to allow authorized personnel access, and the activation delay time is in process. An alarm status LED 74 is lit whenever the door-mounted control unit 20 is armed. A system lockout LED 76 is lit whenever the system lockout switch 60 has been activated. Finally, an alarm output LED 78 is lit whenever the system is armed and the system trigger 40 has been activated to initiate an alarm output from the output control circuitry 44, until the system is reset or disarmed.

Figure 2:
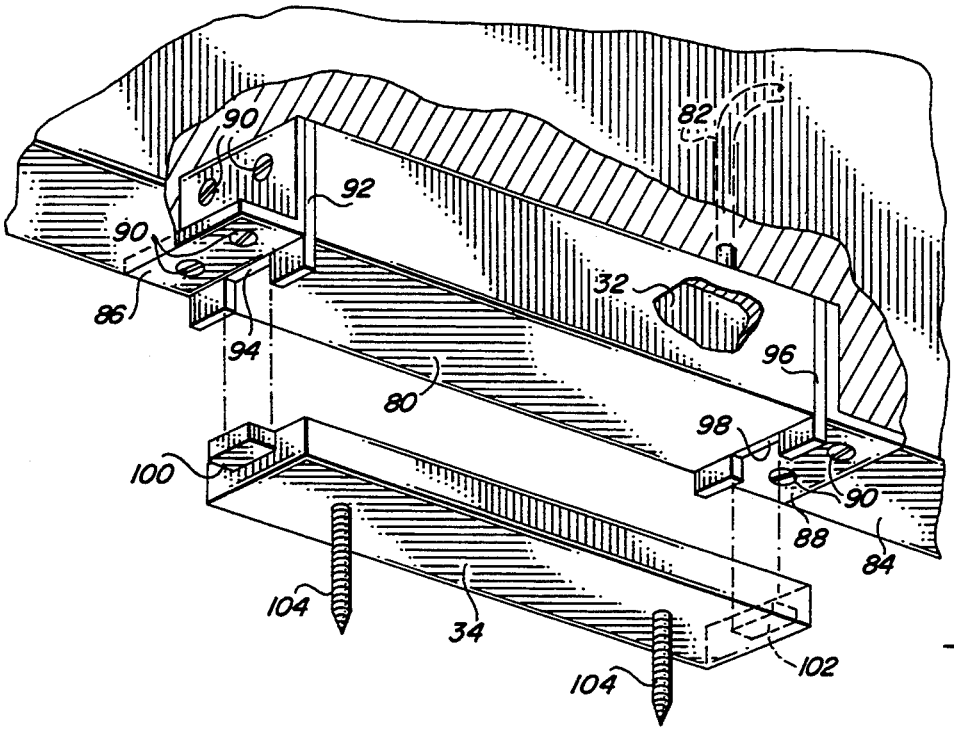
FIG. 2 is a schematic front perspective view of an electromagnetic door lock system which can be used with the present invention, showing an electromagnetic door lock device installed in a doorway, with an armature shown therebelow which armature is for mounting on the top of a door.

Referring next to FIG. 2, an electromagnetic door locking mechanism similar to that in the above incorporated by reference Geringer '497 patent is illustrated. The portions of the electromagnetic door locking mechanism containing the lock coil 32 and the armature 34 are illustrated. The lock coil 32 is disposed in a rectangular metallic housing 80, and is connected to the microprocessor-based control circuitry 24 (not shown in FIG. 2) by an electrical conduit 82 passing through the housing 80.

The housing 80 is held in place in the underside of the top of a door frame 84 (where it forms part thereof) by a pair of L-shaped brackets 86 and 88 secured to opposite sides of the housing 80 and to the door frame 84 by screws 90. A flat vertical plate 92 is secured between the L-shaped bracket 86 and the housing 80 by the screws 90. The flat vertical plate 92 extends below the bottom of the housing 80 and the L-shaped bracket 86, and there is a slot 94 centrally located in the bottom edge of the flat vertical plate 92. Similarly, a flat vertical plate 96 is secured between the L-shaped bracket 88 and the housing 80 by the screws 90. The flat vertical plate 96 also extends below the bottom of the housing 80 and the L-shaped bracket 88, and there is a slot 98 centrally located in the bottom edge of the flat vertical plate 96.

The armature 34 is rectangular, and has centrally located protrusions 100 and 102 extending from the ends thereof at the top thereof. The armature 34 is formed of a magnetically attractable material, and is connected to the top surface of a door (not shown) by a pair of screws 104. The screws 104 each have a head vertically seated in a loose pocket in the armature 34. Accordingly, the armature 34 will be able to move vertically upward from a position on the top of the door when attracted to the lock coil 32. When the armature 34 is in this position, the protrusion 100 of the armature 34 will be received in the slot 94 in the flat vertical plate 92, and the protrusion 102 of the armature 34 will be received in the slot 98 in the flat vertical plate 96. In this position, the door will be retained in a locked position.

Figure 3:
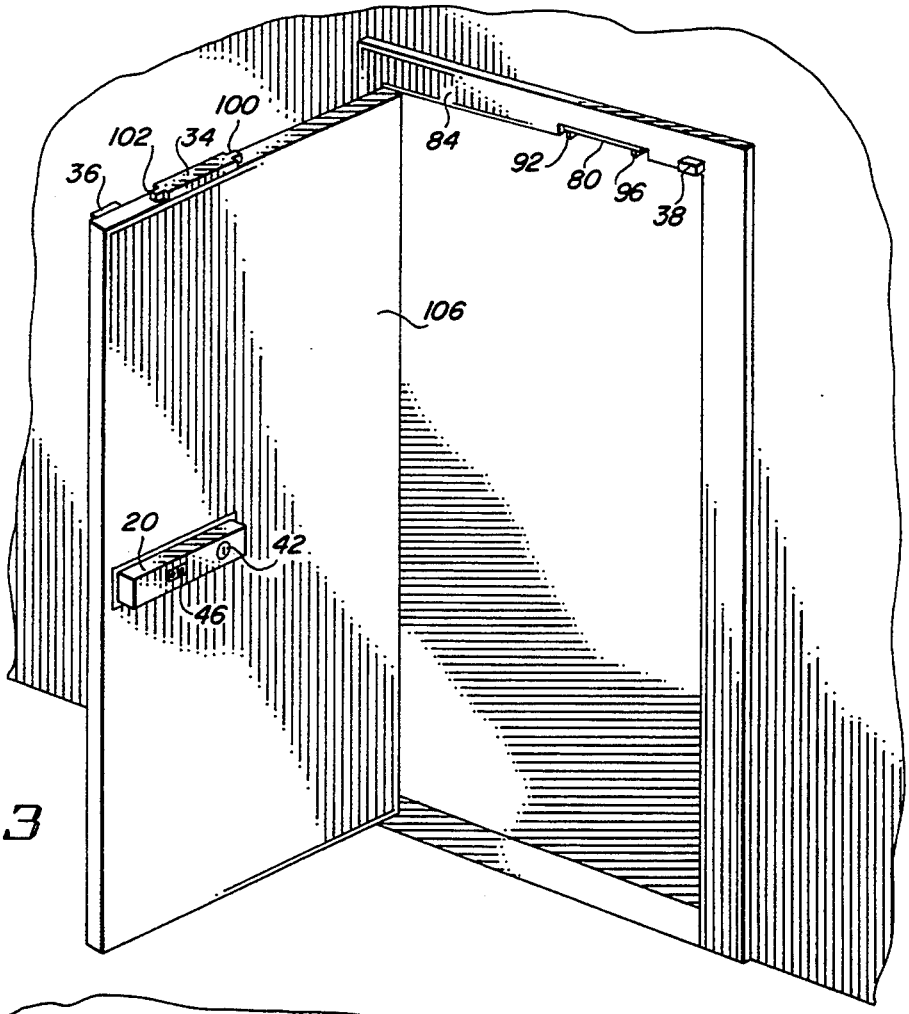
FIG. 3 is a perspective view of a door and a door frame, showing a door-mounted version of the control system illustrated in FIG. 1 for the delayed egress locking system of the present invention, and also showing the electromagnetic door lock system shown in FIG. 2 installed on a door and a door frame.

Referring next to FIG. 3, a door 106 is shown mounted in the door frame 84. The housing 80 containing the lock coil 32 is mounted in the door frame 84, and the door switch actuator 38 is mounted on the door frame 84. The armature 34 is mounted on the top of the door 106, and the door position switch 36 is mounted on the door 106. The door-mounted control unit 20 is shown mounted on the door 106, with the remote arm/-disarm switch 42 and the status display 46 mounted on the door-mounted control unit 20.

Figure 4:
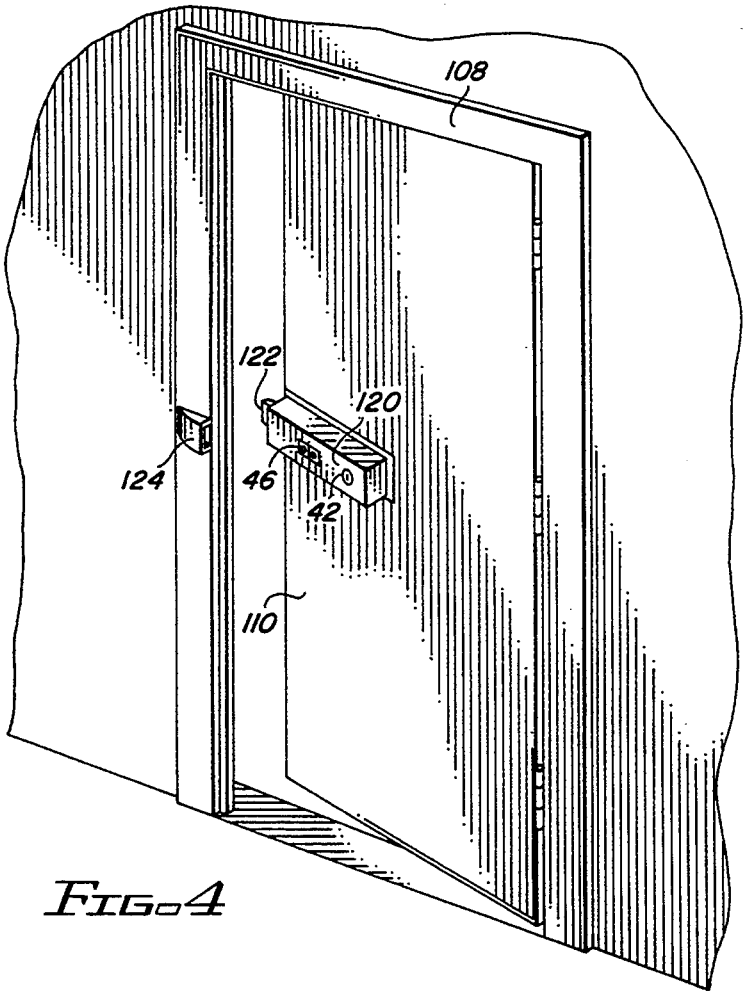
FIG. 4 is a perspective view of a door and a door frame, showing a door-mounted version of the control system illustrated in FIG. 1 for the delayed egress locking system of the present invention embodied in a push bar deadbolt lock system.

Referring next to FIG. 4, another door frame 108 and door 110 are shown with a variation 120 of the door-mounted control unit 20. The door-mounted control unit 120 is a push bar deadbolt lock system, with a deadbolt 122 extending from the side of the door-mounted control unit 120. A latch member 124 is shown mounted on the side of the frame 108. The door-mounted control unit 120 contains the remote arm/disarm switch 42 and the status display 46, and operates similarly to the door-mounted control unit 20 described above.

Figure 5:
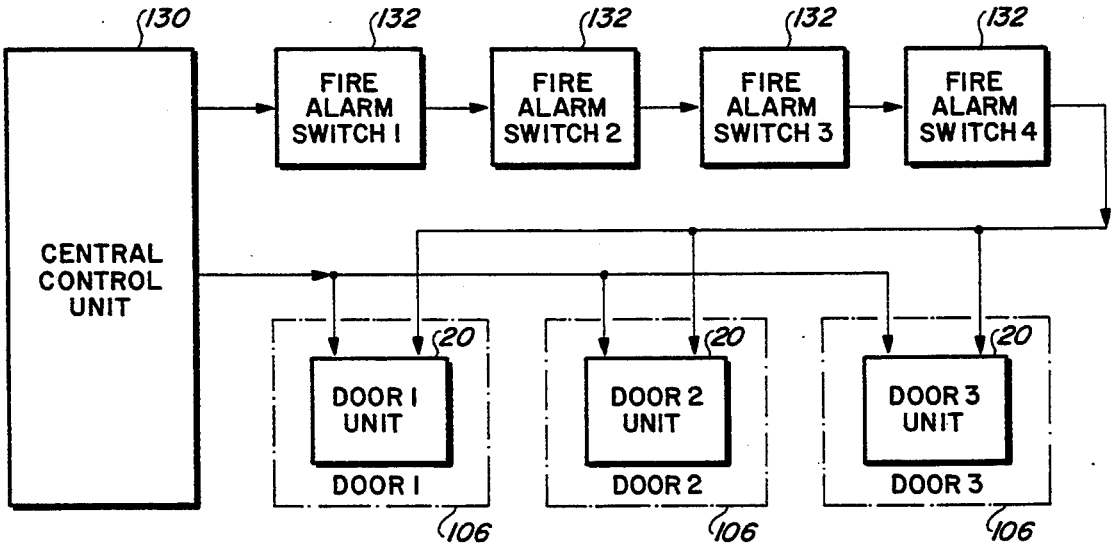
FIG. 5 is a functional schematic block diagram of the delayed egress locking system of the present invention used on three doors, and also shows the remote master console and five fire alarm switches which are activated in the event of a fire at the alarm switch locations.

Referring finally to FIG. 5, a central control unit 130 is shown connected to three door-mounted control units 20, each of which is mounted on a door 106. Four fire alarm switches 132 are connected together to provide the fire alarm stations input to the door-mounted control units 20. The door-mounted control units 20 can be set up to alarm individually, or as a group, if desired. Other aspects of multiple units are readily apparent to those skilled in the art.

It may therefore be appreciated from the above detailed description of the preferred embodiment of the present invention that it teaches a security system which, when actuated by an individual trying to open a secured door, will provide visual and/or audible information about the delay before the door will be unlocked to the individual trying to open the door. Such information will serve to precisely and definitely inform the individual that the door will be opened following a brief delay. In fact, the exact delay will be presented by the preferred embodiment device in both visual form and in audible form to the individual seeking egress or access through the door.

The security system of the present invention enables the locking mechanism to operate to open the door after a preset period of time, with that preset period being adjustable in duration. In addition, the security system of the present invention operates to ensure that the locking mechanism will operate in a fail-safe mode, immediately unlocking the door in the event of a fire or another bona fide emergency, and operating all doors in the affected area. Also, the security system of the present invention allows immediate egress or access to a security officer. It also provides information on its operational status to a single remote location.

The security system apparatus of the present invention is of a construction which is both durable and long lasting, and which will require little or no maintenance to be provided by the user. In order to enhance the market appeal of the security system of the present invention, it is of relatively inexpensive construction to thereby afford it the broadest possible market. Finally, all of the aforesaid advantages and objectives of the present invention are achieved without incurring any substantial relative disadvantage.

Although an exemplary embodiment of the present invention has been shown and described with reference to particular embodiments and applications thereof, it will be apparent to those having ordinary skill in the art that a number of changes, modifications, or alterations to the invention as described herein may be made, none of which depart from the spirit or scope of the present invention. All such changes, modifications, and alterations should therefore be seen as being within the scope of the present invention.

What is claimed is:

1. A security system for use with an exit door hingedly mounted in a door frame, said security system comprising:

an electrically operated door locking mechanism having a locked condition for securing the exit door in a closed position, and an unlocked condition for allowing the exit door to be opened;

trigger switch means for demanding egress through the exit door when said trigger switch means is actuated;

control means for operating said electrically activated door locking mechanism, said control means including a timer for timing an egress delay period, said timer being started when said trigger switch means is actuated, said control means causing said electrically operated door locking mechanism to go from said locked condition to said unlocked condition when said timer finishes timing said egress delay period means for providing an alarm when said trigger switch means is actuated; and means associated with the exit door, for providing an informative output regarding the condition of said electrically operated door locking mechanism following the actuation of said trigger switch means, wherein said means for providing an information output comprises:

means for providing an indication of the time remaining until said electrically operated door locking mechanism will go from said locked condition to said unlocked condition.

2. A security system as defined in claim 1, wherein said electrically operated door locking mechanism comprises:

an electromagnetically operated door locking mechanism.

3. A security system as defined in claim 2, wherein said electromagnetically operated door locking mechanism comprises:

an electromagnetic coil member secured to the door frame; and a magnetically attractable armature secured to the exit door and adapted to be attracted to and held by said electromagnetic coil member.

4. A security system as defined in claim 3, additionally comprising:

first mechanically engaging means associated with said electromagnetic coil member and mounted on the door frame; and second mechanically engaging means associated with said armature and mounted on said door, said first and second mechanically engaging means engaging to secure the exit door in said closed position when electromagnetic coil member is energized, said first and second mechanically engaging means disengaging to allow the exit door to be opened when said electromagnetic coil member is deenergized, said control means maintaining said electromagnetic coil member in an energized state until said timer finishes timing said egress delay period.

5. A security system as defined in claim 4, additionally comprising:

means for verifying that said first and second mechanically engaging means have properly engaged to secure the exit door in said closed position when electromagnetic coil member is energized.

6. A security system as defined in claim 3, additionally comprising:

door switch means for verifying that the exit door is in a closed position prior to allowing said electromagnetic coil member to be energized.

7. A security system as defined in claim 3, additionally comprising:

magnetic flux cancelling means for cancelling the magnetic flux in said electromagnetic coil member when said electromagnetic coil member is deenergized.

8. A security system as defined in claim 1, additionally comprising:

means for accepting an input from one or more fire, smoke, or siesmic, or flow valve status alarms, said input from said one or more alarms having a first state indicative of a normal condition and a second state indicative of an emergency condition; and means for overriding said control means and causing said electrically operated door locking mechanism to go from said locked condition to said unlocked condition whenever said status alarms have said second state indicative of an emergency condition.

9. A security system as defined in claim 1, wherein said trigger switch means comprises:

a push bar or lock mechanism mounted on the exit door.

10. A security system as defined in claim 1, wherein said control means comprises:

a microprocessor.

11. A security system as defined in claim 1, wherein said means for providing an alarm comprises:

means, associated with the exit door, for providing an audible alarm.

12. A security system as defined in claim 11, wherein said means for providing an alarm additionally comprises:

means, located remotely from the exit door, for providing an alarm.

13. A security system as defined in claim 1, additionally comprising:

means for varying the length of said egress delay period.

14. A security system as defined in claim 1, additionally comprising:

means, associated with the exit door, for selectively arming, disarming, and resetting said security system.

15. A security system as defined in claim 14, wherein said means for selectively arming, disarming, and resetting said security system provides an activation delay period following arming or resetting during which said electrically operated door locking mechanism is in said unlocked condition, said activation delay period being variable in length.

16. A security system as defined in claim 1, additionally comprising:

means, located remotely from the exit door, for selectively arming, disarming, shunting and resetting said security system.

17. A security system as defined in claim 1, additionally comprising:

means, located remotely from the exit door, for indicating the status of said security system.

18. A security system as defined in claim 1, wherein said means for providing an indication comprises:

means for providing a visual indication of the time remaining until said electrically operated door locking mechanism will go from said locked condition to said unlocked condition.

19. A security system as defined in claim 18, wherein said means for providing a visual indication comprises:

a digital display exhibiting the number of seconds remaining until said electrically operated door locking mechanism will go from said locked condition to said unlocked condition.

20. A security system as defined in claim 18, wherein said means for providing an informative output additionally comprises:

means for providing an audible speech output informative relative to the present condition regarding said electrically operated door locking mechanism going from said locked condition to said unlocked condition.

21. A security system as defined in claim 1, wherein said means for providing an indication comprises:

means for providing an audible speech output informative relative to the present condition regarding said electrically operated door locking mechanism going from said locked condition to said unlocked condition.

22. A security system as defined in claim 21, wherein said means for providing an audible speech output comprises:

a speech synthesizer.

23. A security system as defined in claim 21, additionally comprising:

means for selecting one or more languages in which said audible speech output will be delivered.

* * * * *